US009780439B2

(12) United States Patent
Liou et al.

(10) Patent No.: US 9,780,439 B2
(45) Date of Patent: Oct. 3, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 154 days.

(21) Appl. No.: 14/510,530

(22) Filed: Oct. 9, 2014

(65) Prior Publication Data

US 2015/0155617 A1 Jun. 4, 2015

(30) Foreign Application Priority Data

Nov. 30, 2013 (CN) ..... 2013 1 0622125

(51) Int. Cl.

| | |
|---|---|
| ***H01Q 9/04*** | (2006.01) |
| ***H01Q 1/24*** | (2006.01) |
| ***H01Q 5/335*** | (2015.01) |
| ***H01Q 5/371*** | (2015.01) |

(52) U.S. Cl.
CPC ..... *H01Q 1/243* (2013.01); *H01Q 5/335* (2015.01); *H01Q 5/371* (2015.01); *H01Q 9/0407* (2013.01)

(58) Field of Classification Search
USPC ..... 343/702, 700 MS
See application file for complete search history.

(56) References Cited

U.S. PATENT DOCUMENTS 6,133,880 A * 10/2000 Grangeat ..... H01P 5/08 343/700 MS
7,768,466 B2 * 8/2010 Chi ..... H01Q 7/00 343/700 MS
8,081,122 B2 * 12/2011 Kearney ..... H01Q 1/36 343/700 MS

* cited by examiner

*Primary Examiner* — Jessica Han
*Assistant Examiner* — Hai Tran
(74) *Attorney, Agent, or Firm* — Steven Reiss

(57) ABSTRACT

An antenna structure includes a feed portion, a ground portion, a first radiator, a second radiator, a first metallic sheet, and a second metallic sheet. The first radiator is coupled to the feed portion. The second radiator is spaced from the first radiator, and is electronically coupled to the first radiator. The first metallic sheet is coupled to the ground portion. The first metallic sheet and the second metallic sheet are connected to two opposite sides of the second radiator.

16 Claims, 6 Drawing Sheets

ANTENNA STRUCTURE AND WIRELESS COMMUNICATION DEVICE USING THE SAME

FIELD

The disclosure generally relates to antenna structures, and particularly to a multiband antenna structure, and a wireless communication device using the same.

BACKGROUND

Antennas are used in wireless communication devices such as mobile phones. The wireless communication device uses a multiband antenna to receive/transmit wireless signals at different frequencies, such as wireless signals operated in an long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
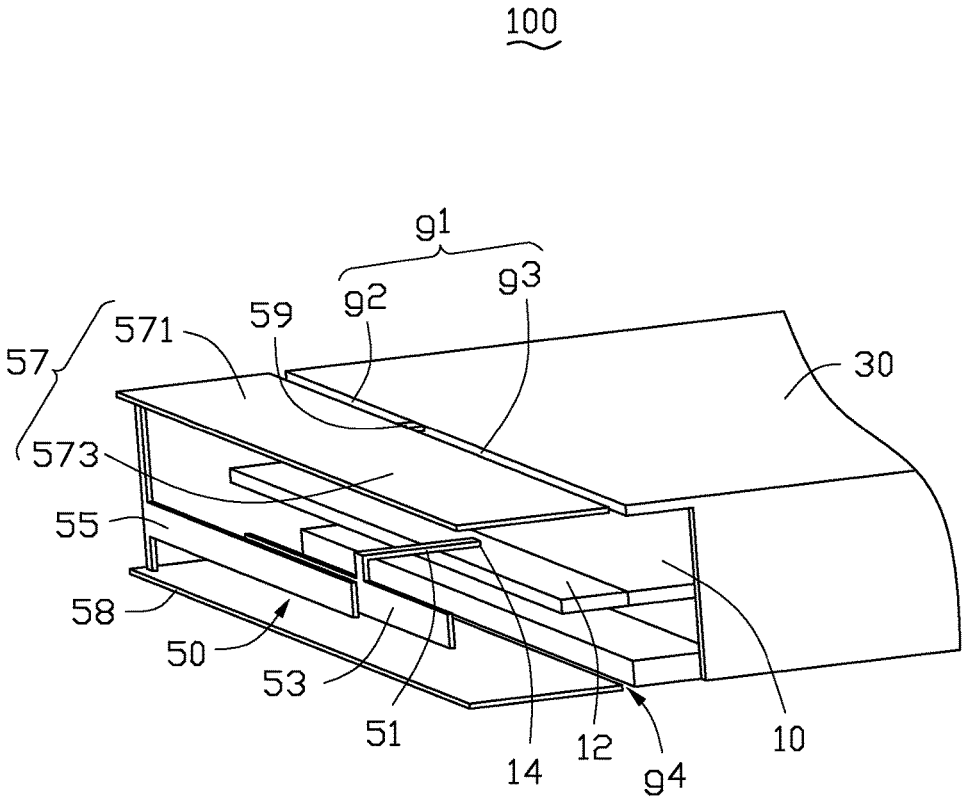
FIG. 1 is an isometric view of a wireless communication device employing an antenna structure, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 100 employing an antenna structure 50, according to an exemplary embodiment. The wireless communication device 100 can be a mobile phone, a tablet, or an intelligent watch, for example (details not shown). The wireless communication device 100 further includes a baseboard 10 and a housing 30 surrounding the baseboard 10. The antenna structure 50 is positioned on the baseboard 10 and is spaced from the housing 30.

The baseboard 10 can be a printed circuit board (PCB) of the wireless communication device 100. The baseboard 10 forms a keep-out-zone 12. The purpose of the keep-out-zone 12 is to delineate an area on the baseboard 10 in which other electronic components (such as a camera, a vibrator, a speaker, etc.) cannot be placed. In at least one embodiment, the keep-out-zone 12 is disposed on an end of the baseboard 10. The keep-out-zone 12 forms a feed pin 14 for providing current to the antenna structure 50.

The antenna structure 50 includes a feed portion 51, a first radiator 53, a second radiator 55, a first metallic sheet 57, a second metallic sheet 58, and a ground portion 59.

The feed portion 51 is a rectangular sheet, and is coupled to the feed pin 14 to receive the current.

Figure 2:
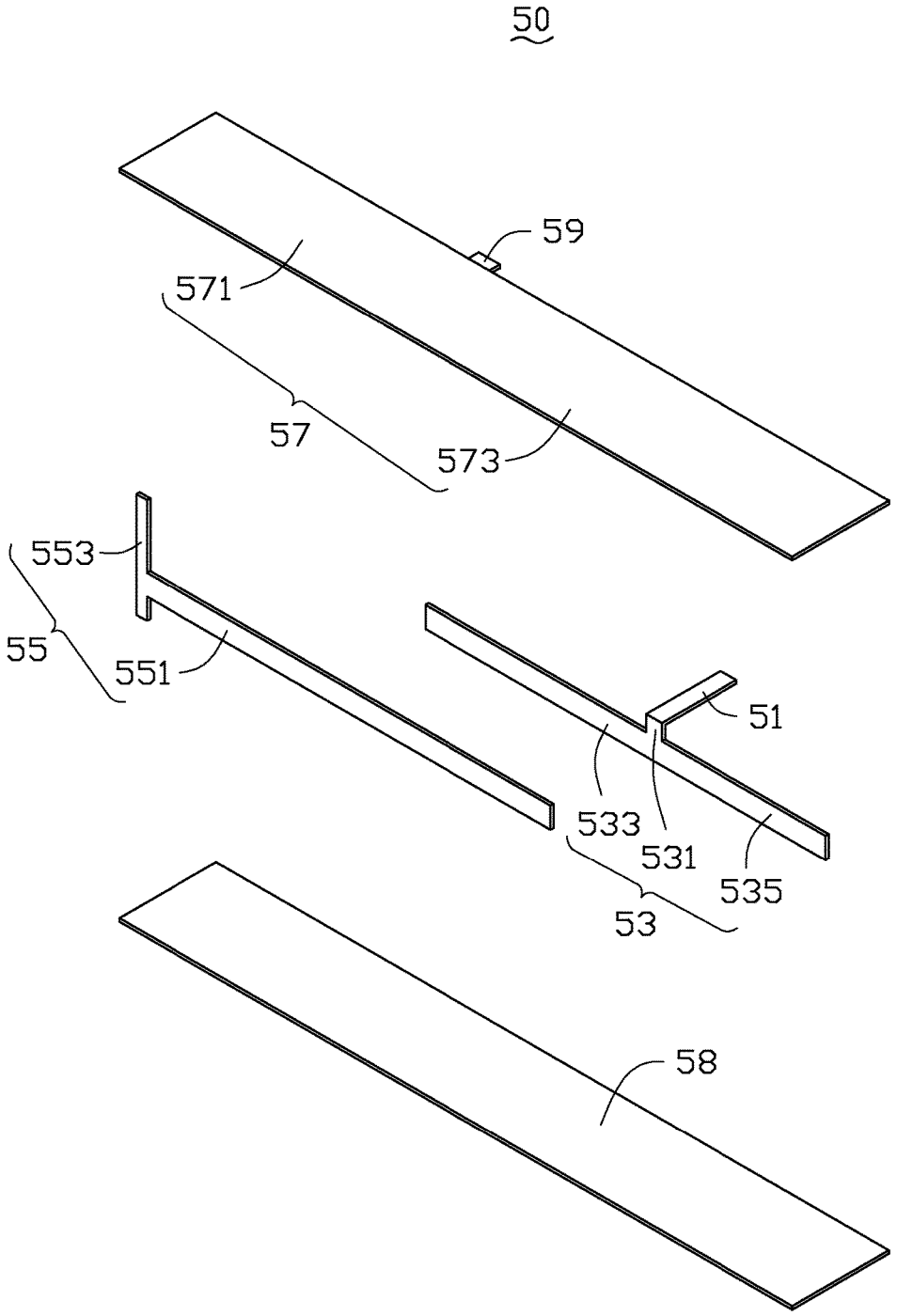
FIG. 2 is an exploded view of the antenna structure of FIG. 1.

A plane of the first radiator 53 is perpendicular to a plane of the baseboard 10. Also referring to FIG. 2, the first radiator 53 includes a first connection section 531, a coupling section 533, and a first radiation section 535. The first connection section 531 is perpendicularly connected to the feed portion 51 and extends towards a side of the feed portion 51. The coupling section 533 and the first radiation section 535 are perpendicularly connected to two opposite sides of the feed portion 51 and extend away from each other. Thus, the first radiator 53 can form a T-shaped sheet.

A plane of the second radiator 55 is perpendicular to a plane of the baseboard 10 and is spaced from the first radiator 53. The second radiator 55 includes a second radiation section 551 and a second connection section 553. The second radiation section 551 is spaced from the coupling section 533 to allow current to pass from the coupling section 533 to the second radiation section 551. Additionally, the second radiation section 551 is perpendicularly connected to a middle portion of the second connection section 553. Thus, the second radiator 55 can form a T-shaped sheet.

Both the first metallic sheet 57 and the second metallic sheet 58 can be a metallic housing of the wireless communication device 100. Referring to FIG. 1, both the first metallic sheet 57 and the second metallic sheet 58 are rectangular sheets, and are positioned at two opposite sides of the keep-out-zone 12. The first metallic sheet 57 and the second metallic sheet 58 are perpendicularly connected to two opposite distal ends of the second connection section 553, respectively. A slot g1 is defined between the first metallic sheet 57 and the housing 30, and a gap g4 is defined between the second metallic sheet 58 and the housing 30. In at least one embodiment, a width of the slot g1 can be about 1 mm, and a width of the gap g4 can be about 5 mm.

In addition, the first metallic sheet 57 includes a first radiation portion 571 and a second radiation portion 573, and the ground portion 59 is formed a junction of the first radiation portion 571 and the second radiation portion 573. The ground portion 59 transversely crosses over the slot g1 to connected to the housing 30, thereby dividing the slot g1 into a first slot g2 and a second slot g3. Since the ground portion 59 is coupled to the housing 30, thus, the antenna structure 50 can be grounded.

Figure 3:
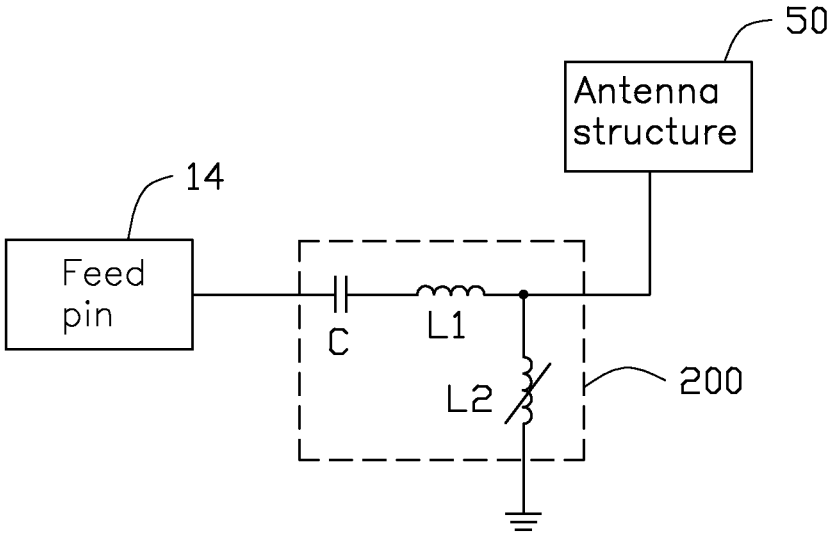
FIG. 3 is a circuit view of a matching circuit of the antenna structure of FIG. 1.

FIG. 3 illustrates that the wireless communication device 100 further includes a matching circuit 200. The matching circuit 200 is coupled between the feed portion 51 and the feed pin 14, and is configured to match an impedance of the antenna structure 50, for optimizing performance of the antenna structure 50 when the antenna structure 50 works in a low frequency mode. In at least one embodiment, the matching circuit 200 includes a capacitor C, a first inductor L1, and a second inductor L2. The capacitor C and the first inductor L1 are electronically connected between the feed pin 14 and the antenna structure 50 in series. A first end of the second inductor L2 is coupled between the first inductor L1 and the antenna structure 50, and a second end of the second inductor L2 is grounded. A capacitance value of the capacitor C can be, for example, about 15 pF, and an inductance value of the first inductor L1 can be, for example, about 5 nH. The second inductor L2 can be a variable inductor, and an inductance value of the second inductor L2 can be, for example, about 5-68 nH.

Figure 4:
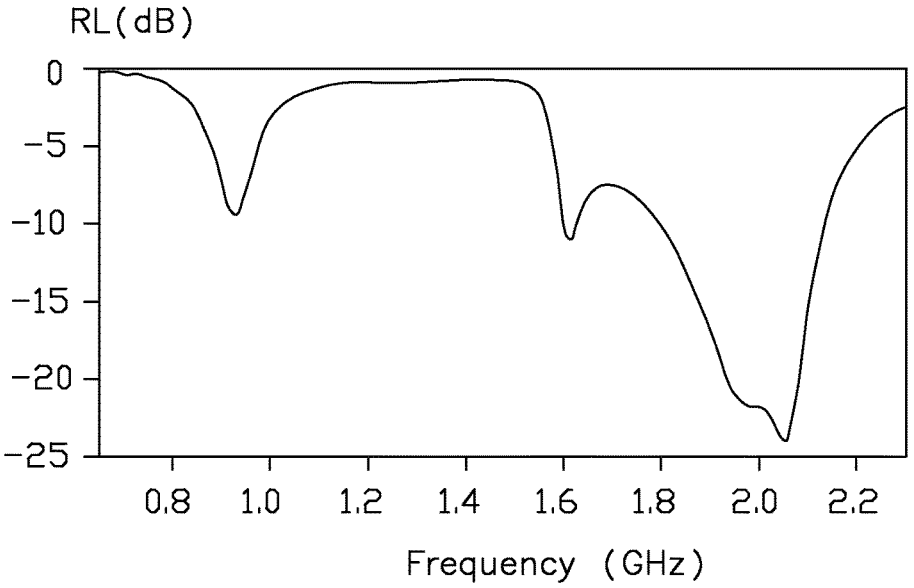
FIG. 4 is a return loss (RL) graph of the antenna structure of FIG. 1 operating in a first low frequency mode.
Figure 5:
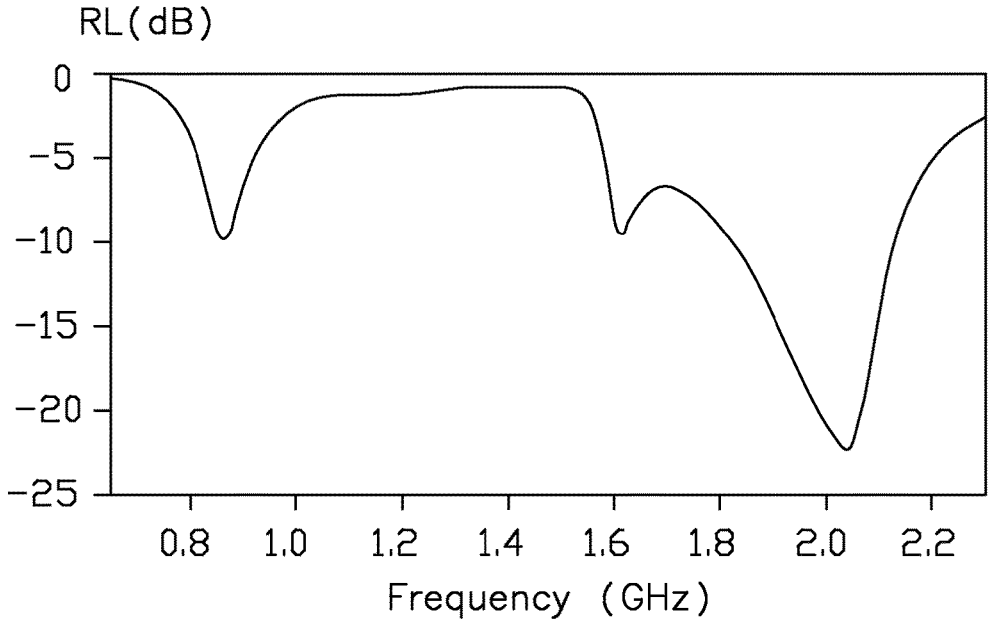
FIG. 5 is a RL graph of the antenna structure of FIG. 1 operating in a second low frequency mode.
Figure 6:
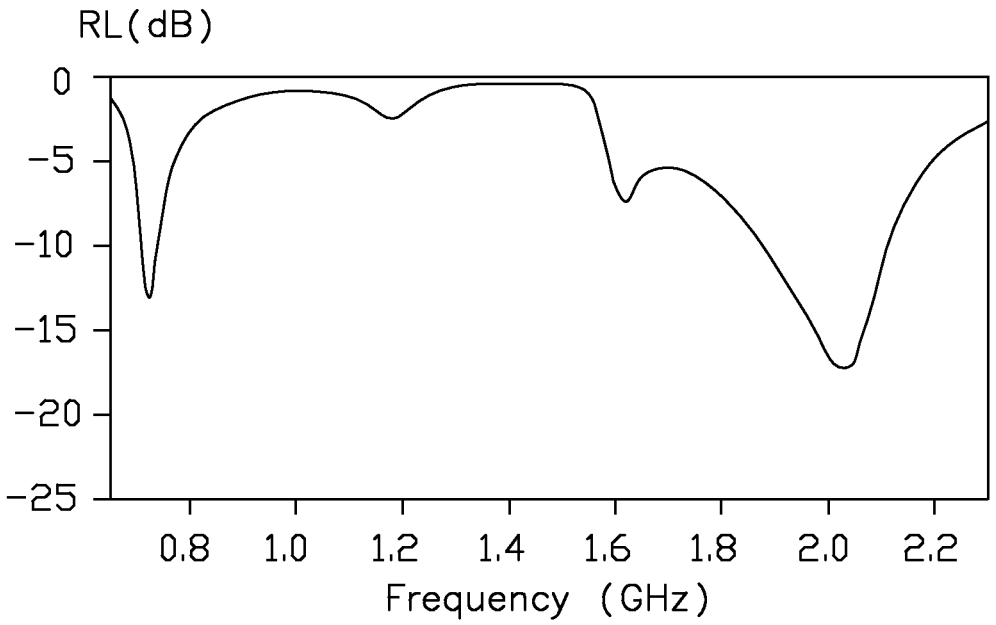
FIG. 6 is a RL graph of the antenna structure of FIG. 1 operated in a third low frequency mode.

When current is input to the feed pin 14, the current flows to the matching circuit 200, the feed portion 51, and the coupling section 533, and then is coupled to the second radiation section 551. Thus, the second radiation section 551, the second connection section 553, and the second metallic sheet 58 form a first current path for resonating a low frequency mode. FIG. 4 illustrates an RL graph of the antenna structure 50 operating in a first low frequency mode. When the inductance value of the second inductor L2 is about 10 nH, a bandwidth of the first low frequency mode can be about 880-960 MHz, and a central frequency of the first low frequency mode can be, for example, about 900 MHz. FIG. 5 illustrates an RL graph of the antenna structure 50 operating in a second low frequency mode. When the inductance value of the second inductor L2 is about 13.5 nH, a bandwidth of the second low frequency mode can be about 824-894 MHz, and a central frequency of the second low frequency mode can be, for example, about 850 MHz. FIG. 6 illustrates an RL graph of the antenna structure 50 operating in a third low frequency mode. When the inductance value of the second inductor L2 is about 33 nH, a bandwidth of the third low frequency mode can be about 698-746 MHz, and a central frequency of the third low frequency mode can be, for example, about 700 MHz.

Additionally, the current flowing on the second radiation section 551, the second connection section 553, and the second metallic sheet 58 resonates a first high frequency mode due to frequency-doubled effect. In at least one embodiment, a central frequency of the first high frequency mode can be, for example, about 2050 MHz. Furthermore, the current flowing on the second radiation portion 573 and the second slot g3 resonates a second high frequency mode. In at least one embodiment, a central frequency of the second high frequency mode can be, for example, about 1650 MHz. Moreover, the current flowing on the first radiation section, the first radiation portion 573, and the first slot g2 resonates a third high frequency mode. In at least one embodiment, a central frequency of the third high frequency mode can be, for example, about 1950 MHz.

In view of curves shown on the FIGS. 4-6, the wireless communication device 100 has good performance when operating at 704-960 MHZ and 1710-2170 MHZ.

In summary, the second radiator 55 is coupled to the first metallic sheet 57 and the second metallic sheet 58, and the ground portion 59 is coupled to the first metallic sheet 57 and the housing 30. Thus, the first metallic sheet 57 and the second metallic sheet 58 can serve as a part of the antenna structure 50, which allows further size reductions of the wireless communication device 100 employing the antenna structure 50. In addition, a radiating capability of the antenna structure 50 of the wireless communication device 100 is effectively improved because of the matching circuit 200.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. An antenna structure comprising:

a feed portion;

a ground portion;

a first radiator coupled to the feed portion, the first radiator positioned in a first plane;

a second radiator spaced from the first radiator, and electronically coupled to the first radiator, the second radiator positioned in a second plane substantially parallel to the first plane;

a first metallic sheet coupled to the ground portion; and a second metallic sheet;

wherein the first metallic sheet and the second metallic sheet are connected to two opposite sides of the second radiator;

wherein the feed portion is positioned in a third plane substantially perpendicular to the first plane;

wherein the feed portion is positioned in the third plane substantially parallel to the first metallic sheet and the second metallic sheet, and positioned between the first metallic sheet and the second metallic sheet;

wherein the first radiator is spaced from the first and second metallic sheets.

2. The antenna structure as claimed in claim 1, wherein the first radiator comprises a first connection section coupled to the feed portion.

3. The antenna structure as claimed in claim 2, wherein the first radiator further comprises a coupling section and a first radiation section, the coupling section and the first radiation section are perpendicularly connected to two opposite sides of the feed portion and extend away from each other.

4. The antenna structure as claimed in claim 3, wherein the second radiator comprises a second radiation section spaced from the coupling section and electronically coupled to the coupling section.

5. The antenna structure as claimed in claim 4, wherein the second radiator further comprises a second connection section, the second radiation section is perpendicularly connected to a middle portion of the second connection section, and the first metallic sheet and the second metallic sheet are connected to two opposite sides of the second connection section.

6. The wireless communication device as claimed in claim 1, wherein the first metallic sheet is positioned in a fourth plane substantially perpendicular to the first plane and the second plane, and substantially parallel to the third plane, the second metallic sheet is positioned in a fifth plane substantially perpendicular to the first plane and the second plane, and substantially parallel to the third plane and the fourth plane.

7. A wireless communication device comprising:

a baseboard; and an antenna structure positioned on the baseboard, the antenna structure comprising:

a feed portion;

a ground portion;

a first radiator coupled to the feed portion, the first radiator positioned in a first plane;

a second radiator spaced from the first radiator, and electronically coupled to the first radiator, the second radiator positioned in a second plane substantially parallel to the first plane;

a first metallic sheet coupled to the ground portion; and a second metallic sheet;

wherein the first metallic sheet and the second metallic sheet are connected to two opposite sides of the second radiator;

wherein the feed portion is positioned in a third plane substantially perpendicular to the first plane;

wherein the feed portion is positioned in the third plane substantially parallel to the first metallic sheet and the second metallic sheet, and positioned between the first metallic sheet and the second metallic sheet;

wherein the first radiator is spaced from the first and second metallic sheets.

8. The wireless communication device as claimed in claim 7, wherein the first radiator comprises a first connection section coupled to the feed portion.

9. The wireless communication device as claimed in claim 8, wherein the first radiator further comprises a coupling section and a first radiation section, the coupling section and the first radiation section are perpendicularly connected to two opposite sides of the feed portion and extend away from each other.

10. The wireless communication device as claimed in claim 9, wherein the second radiator comprises a second radiation section spaced from the coupling section and electronically coupled to the coupling section.

11. The wireless communication device as claimed in claim 10, wherein the second radiator further comprises a second connection section, the second radiation section is perpendicularly connected to a middle portion of the second connection section, and the first metallic sheet and the second metallic sheet are connected to two opposite sides of the second connection section.

12. The wireless communication device as claimed in claim 7, further comprising:

a housing;

a slot defined between the first metallic sheet and the housing; and a gap defined between the second metallic sheet and the housing.

13. The wireless communication device as claimed in claim 12, wherein the ground portion is coupled between the first metallic sheet and the housing.

14. The wireless communication device as claimed in claim 13, wherein the ground portion transversely crosses over the slot to divide the slot into a first slot and a second slot.

15. The wireless communication device as claimed in claim 7, further comprising a matching circuit, the matching circuit comprises a capacitor, a first inductor, and a second inductor, the baseboard forms a feed pin, the capacitor and the first inductor are electronically connected between the feed pin and the antenna structure in series, a first end of the second inductor is coupled between the first inductor and the antenna structure, and a second end of the second inductor is grounded.

16. The wireless communication device as claimed in claim 7, wherein the first metallic sheet is positioned in a fourth plane substantially perpendicular to the first plane and the second plane, and substantially parallel to the third plane, the second metallic sheet is positioned in a fifth plane substantially perpendicular to the first plane and the second plane, and substantially parallel to the third plane and the fourth plane.

* * * * *